US010195751B2

(12) United States Patent
Shimizu

(10) Patent No.: US 10,195,751 B2
(45) Date of Patent: Feb. 5, 2019

(54) ROTARY ELECTRIC SHAVER

(71) Applicant: Izumi Products Company, Matsumoto-shi, Nagano (JP)

(72) Inventor: Tetsuhiko Shimizu, Matsumoto (JP)

(73) Assignee: IZUMI PRODUCTS COMPANY, Nagano (JP)

( * ) Notice: Subject to any disclaimer, the term of this patent is extended or adjusted under 35 U.S.C. 154(b) by 205 days.

(21) Appl. No.: 15/186,043

(22) Filed: Jun. 17, 2016

(65) Prior Publication Data

US 2017/0008179 A1 Jan. 12, 2017

(30) Foreign Application Priority Data

Jul. 9, 2015 (JP) ..... 2015-137970

(51) Int. Cl.
*B26B 19/14* (2006.01)
*B26B 19/28* (2006.01)
*B26B 19/36* (2006.01)

(52) U.S. Cl.
CPC ..... *B26B 19/145* (2013.01); *B26B 19/14* (2013.01); *B26B 19/143* (2013.01); *B26B 19/146* (2013.01); *B26B 19/28* (2013.01); *B26B 19/36* (2013.01)

(58) Field of Classification Search
CPC ..... B26B 19/145; B26B 19/14; B26B 19/143; B26B 19/146; B26B 19/28; B26B 19/36
See application file for complete search history.

(56) References Cited

U.S. PATENT DOCUMENTS 2,308,920 A 1/1943 Horowitz et al.
5,313,704 A * 5/1994 Atsumi ..... B26B 19/28 30/43.6
8,397,388 B1 3/2013 Steinberg
(Continued)

FOREIGN PATENT DOCUMENTS

CN 1240699 A 1/2000
CN 101094751 A 12/2007
(Continued)

OTHER PUBLICATIONS

Extended European Search Report issued in corresponding EP Application No. 16177313.0 dated Nov. 22, 2016 (in English).
(Continued)

*Primary Examiner* — Omar Flores Sanchez
(74) *Attorney, Agent, or Firm* — Birch, Stewart, Kolasch & Birch, LLP

(57) ABSTRACT

A rotary electric shaver includes a gear case arranged inside a head unit, a lower gear arranged in a lower portion of the gear case, coaxially having an outer blade gear for driving an outer blade and an inner blade gear for driving an inner blade, an upper gear arranged in an upper portion of the gear case to drive the outer blade, and a transmission gear having an input gear arranged in the lower portion of the gear case and to which driving power is input from the lower gear, and an output gear arranged in the upper portion of the gear case to drive the upper gear, in which the input gear and the output gear are coaxial and a rotary shaft vertically penetrates the gear case. The driving power from the upper gear drives an outer blade drive gear for driving the outer blade.

19 Claims, 8 Drawing Sheets

(56) References Cited

U.S. PATENT DOCUMENTS

| | | | | |
|---|---|---|---|---|
| 2008/0134513 | A1 | 6/2008 | Oh | |
| 2014/0352152 | A1* | 12/2014 | Shimizu | B26B 19/146<br>30/43.6 |
| 2017/0144317 | A1* | 5/2017 | Shimizu | B26B 19/141 |
| 2017/0144318 | A1* | 5/2017 | Van Toor | B26B 19/145 |

FOREIGN PATENT DOCUMENTS

| | | | |
|---|---|---|---|
| EP | 0 860 247 | A1 | 8/1998 |
| EP | 0 868 981 | A1 | 10/1998 |
| JP | 3964404 | B2 | 8/2007 |
| JP | 4340336 | B2 | 10/2009 |
| WO | WO 2006/065052 | A1 | 6/2006 |

OTHER PUBLICATIONS

Chinese Office Action and Search Report, dated Nov. 5, 2018 for Chinese Application No. 201610515449.0, with an English translation of the Chinese Office Action.

* cited by examiner

ROTARY ELECTRIC SHAVER

CROSS-REFERENCE TO RELATED APPLICATION

This application is based upon and claims the benefit of priority of the prior Japanese Patent Application No. P2015-137970, filed on Jul. 9, 2015, and the entire contents of which are incorporated herein by reference.

FIELD

The present invention relates to a rotary electric shaver.

BACKGROUND

In the related art, a rotary electric shaver is known in which multiple blade units having an outer blade whose upper surface functions as an annular shaving surface and an inner blade rotating while coming into sliding contact with a lower surface of the outer blade are arranged in a head case held in a main body (refer to PTL 1). As is in the example of the rotary electric shaver, a configuration is generally adopted in which only the inner blade rotates while coming into sliding contact with the fixed outer blade.

However, when a user performs shaving using the rotary electric shaver whose outer blade is fixed (does not rotate), the user frequently moves the rotary electric shaver on the skin as if the user draws a circle, thereby causing a problem in that the user's hand or arm gets tired easily. In order to solve the problem, a rotary electric shaver has been developed in which the outer blade rotates together with the inner blade (refer to PTL 2). According to this configuration, since the outer blade rotates, an advantageous effect can be obtained in that the user's hand moving operations are reduced, and the user's action for raising and catching the hair is improved. Therefore, it is possible to obtain an advantageous effect of improved shaving performance. In this invention, examples of the hair include beards, mustaches, whiskers, and the like.

CITATION LIST

Patent Literature

PTL 1: Japanese Patent No. 3964404
PTL 2: Japanese Patent No. 4340336

SUMMARY OF INVENTION

Technical Problem

Here, the rotary electric shaver disclosed in PTL 2 needs to further include a mechanism for rotating the outer blade, compared to the outer blade-fixed electric shaver in the related art, thereby leading to a problem in that the number of components increases and a structure thereof becomes complicated. As a result, compared to the electric shaver in the related art, there is a problem of an enlarged shape and poor usability. In addition, in terms of design, the enlarged shape causes customers to feel little attraction for the rotary electric shaver disclosed in PTL 2.

The present invention is made in view of the above-described circumstances, and an object thereof is to provide a rotary electric shaver which can rotate an inner blade and an outer blade, and which can realize a compact shape by reducing the number of components and simplifying a structure.

Solution to Problem

The object may be realized by providing a solution disclosed hereinafter as an embodiment.

According to a disclosed rotary electric shaver, multiple blade units having an outer blade whose upper surface serves as an annular shaving surface and an inner blade coming into sliding contact with a lower surface of the outer blade are arranged in a head unit held in a main body, and in which the outer blade and the inner blade are respectively and rotatably driven. The rotary electric shaver includes a gear case that is arranged inside the head unit, a multi-stage structure lower gear that is arranged in a lower portion of the gear case, and that coaxially has an outer blade gear to which driving power is input from a drive source accommodated in the main body and which outputs the driving power to the outer blade, and an inner blade gear which outputs the driving power to the inner blade, an upper gear that is arranged in an upper portion of the gear case, and that outputs the driving power to the outer blade, and a transmission gear that has an input gear which is arranged in the lower portion of the gear case and to which the driving power is input from the lower gear, and an output gear which is arranged in the upper portion of the gear case and which outputs the driving power to the upper gear, in which the input gear and the output gear are coaxially and rotatably connected to each other, and in which a rotary shaft thereof is arranged so as to vertically penetrate the gear case. The driving power from the upper gear drives an outer blade drive gear which drives the outer blade.

Advantageous Effects

According to a disclosed rotary electric shaver, an inner blade and an outer blade can be rotated by using the reduced number of components and a simple structure. Accordingly, a user's hand moving operation can be reduced. Therefore, when in use, the user's hand or arm can feel reduced fatigue, and improved shaving can be conveniently performed. In addition, since a compact shape can be realized, usability is affordable, and customer attracting power can also be improved in terms of design. Furthermore, the user's action for raising and catching the hair can be improved. Therefore, shaving performance and shaving comfortability can be improved.

DESCRIPTION OF THE EMBODIMENTS

Figure 1:
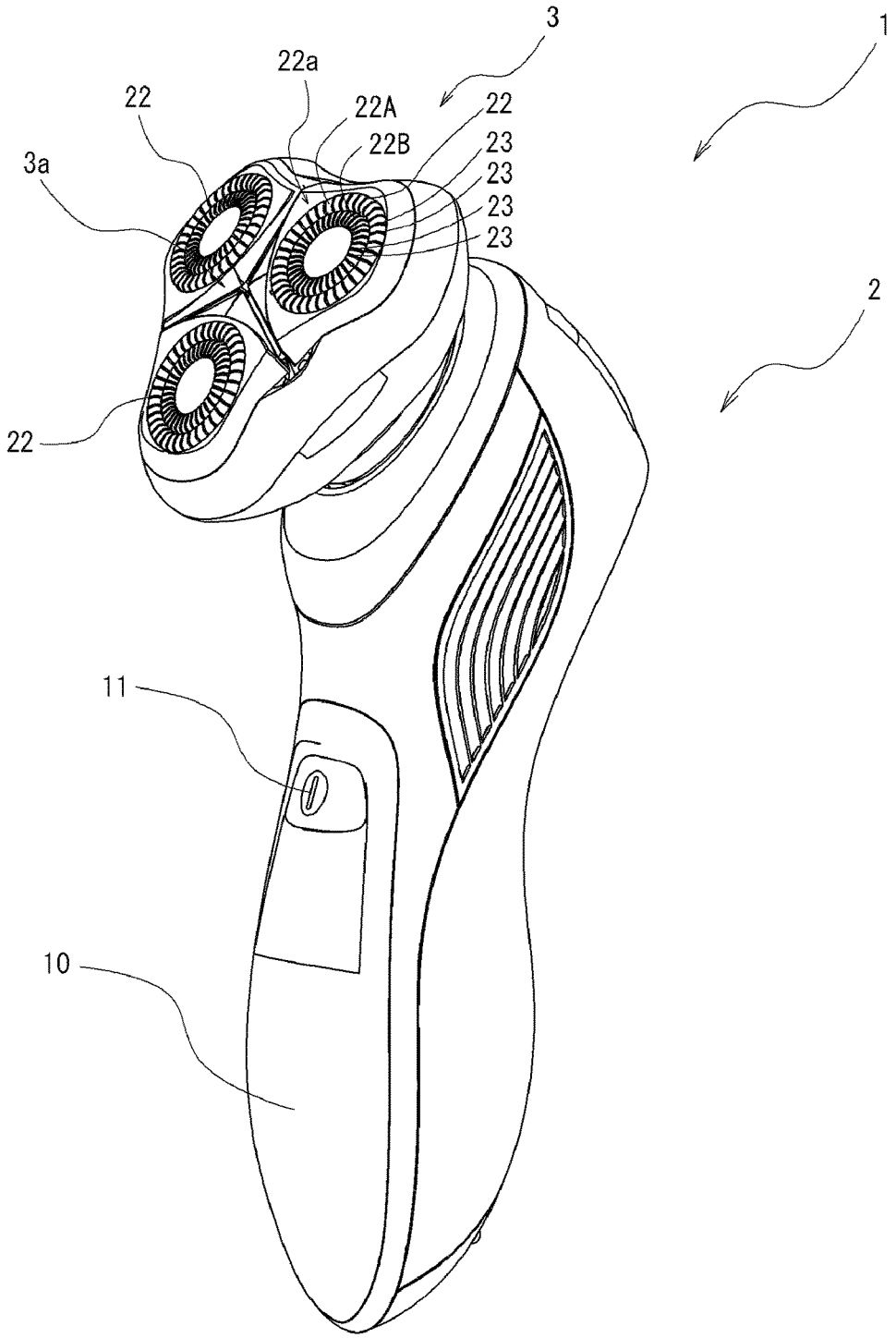
FIG. 1 is a schematic view illustrating an example of a rotary electric shaver according to an embodiment of the present invention.
Figure 2:
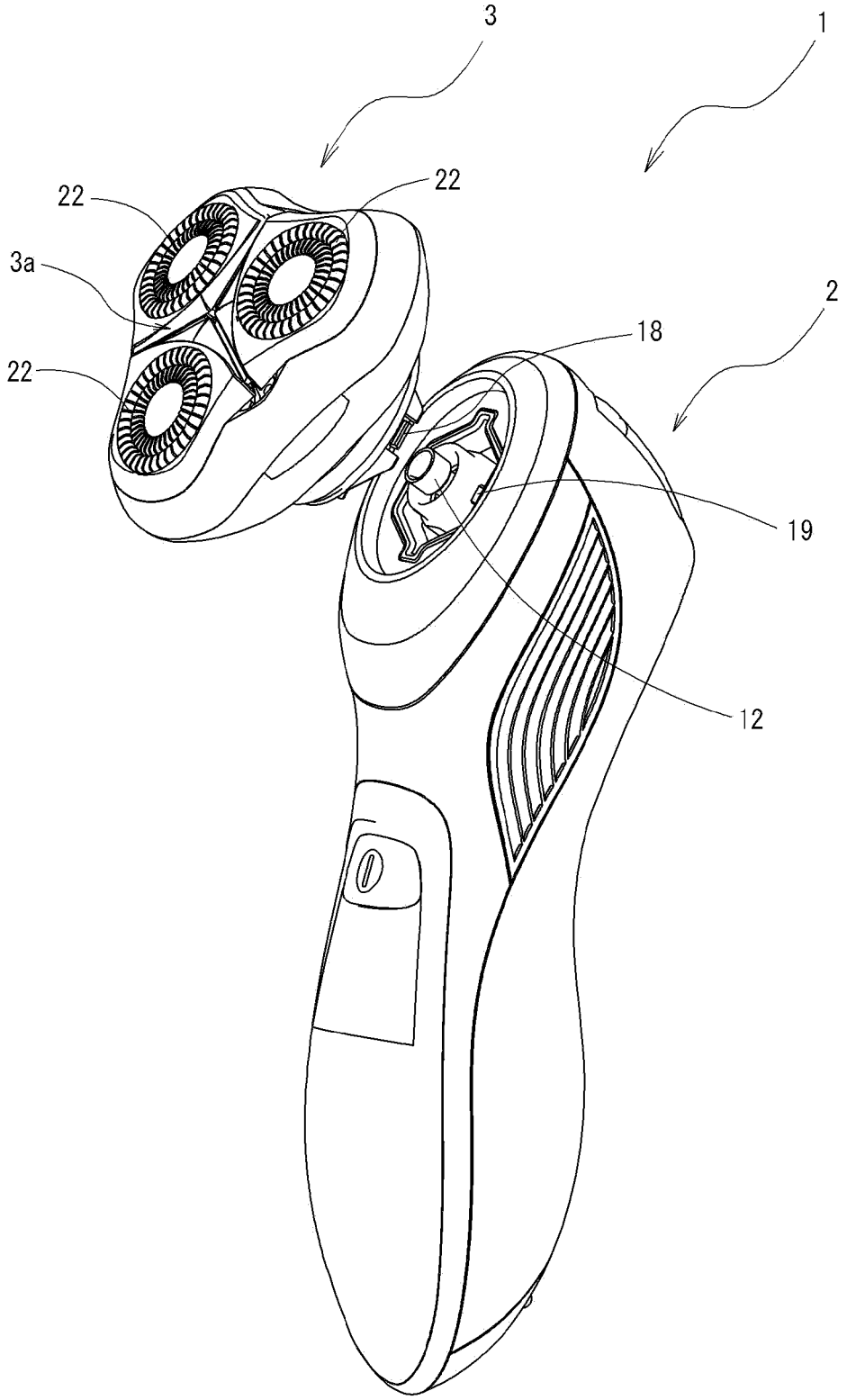
FIG. 2 is a schematic view illustrating a state where a head unit of the rotary electric shaver illustrated in FIG. 1 is detached from a main body.
Figure 3:
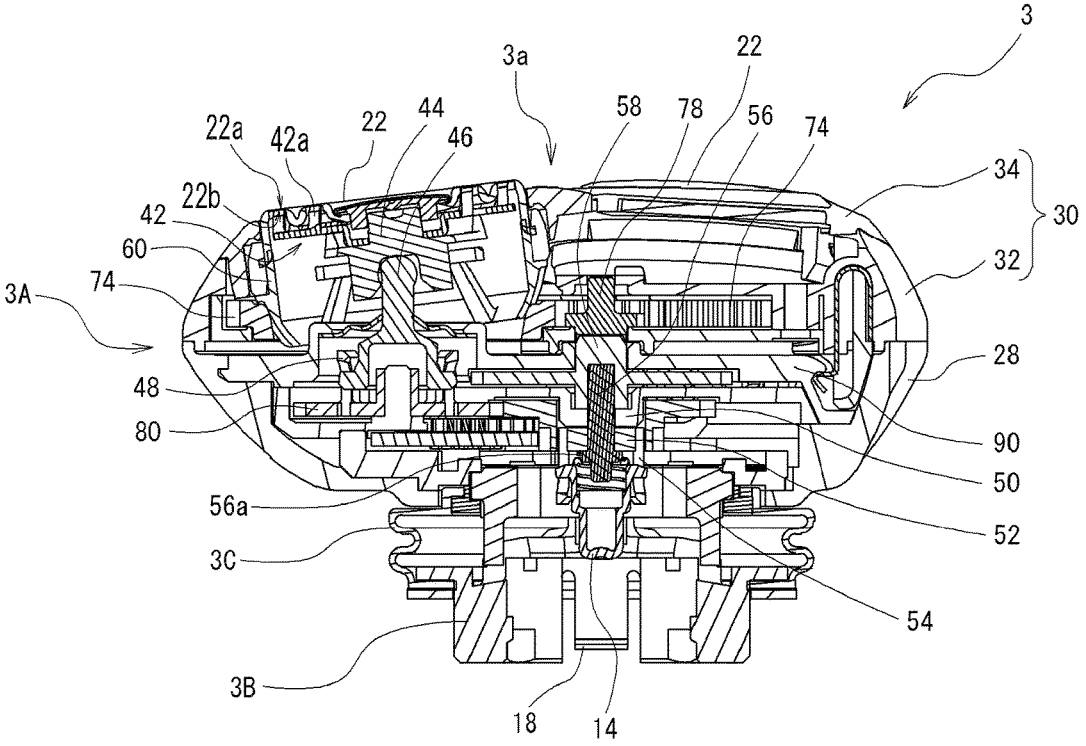
FIG. 3 is a schematic view illustrating an example of the head unit of the rotary electric shaver illustrated in FIG. 1.
Figure 4A:
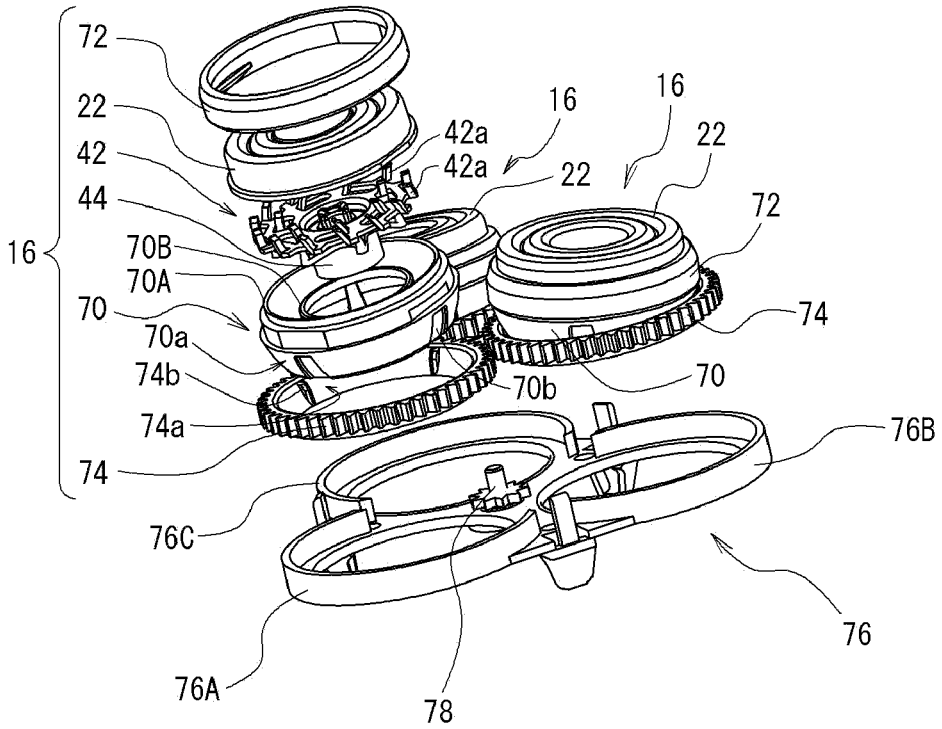
FIGS. 4A and 4B are schematic views illustrating an example of a blade unit of the rotary electric shaver illustrated in FIG. 1.
Figure 4B:
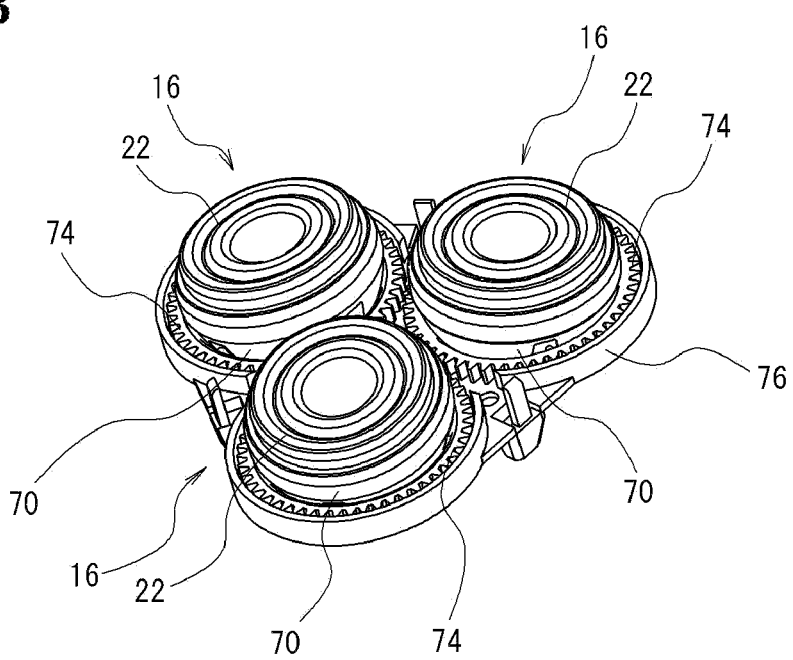

Hereinafter, a first embodiment of the present invention will be described in detail with reference to the drawings. FIG. 1 is a perspective view illustrating an example of a rotary electric shaver 1 according to the present embodiment. In addition, FIG. 2 is a perspective view illustrating a state where a detachable head unit 3 is detached from a main body 2 in the rotary electric shaver 1. In addition, FIG. 3 is a sectional side view illustrating an example of the head unit 3 of the rotary electric shaver 1 illustrated in FIG. 1 (for convenience, description will be made by referring to an upper side position on the paper surface in FIG. 3 as an "upper portion" and referring to a lower side position thereon as a "lower portion"). In addition, FIGS. 4A and 4B are perspective views illustrating an example of a blade unit 16 of the rotary electric shaver 1 illustrated in FIG. 1 (FIG. 4A is a disassembly drawing, and FIG. 4B is an assembly drawing). Referring to all drawings used in describing the embodiment, the same reference numerals will be given to members having the same function, and repeated description thereof will be omitted in some cases.

As illustrated in FIGS. 1 to 4B, the rotary electric shaver 1 according to the present embodiment is configured so that the head unit 3 held in a main body 2 includes an outer blade 22 whose upper surface 22*a* serves as an annular shaving surface (as an example, 22A and 22B) having multiple hair inlets 23 formed thereon, and an inner blade 42 which has a small blade 42*a* coming into sliding contact with a lower surface 22*b* of the outer blade 22. A configuration is adopted in which the outer blade 22 and the inner blade 42 are respectively and rotatably driven in mutually opposite directions or in the same direction so that the outer blade 22 and the inner blade 42 cut the hair entering the hair inlet 23. That is, hair cutting action can be obtained by causing the inner blade 42 to rotate faster than the outer blade 22. Nevertheless, the outer blade 22 is rotated in order to achieve an advantageous effect of a more favorable sensation to the skin by improving a user's action for raising and catching the hair. In the present embodiment, an example will be described in which the rotary electric shaver has three sets of the blade unit 16 configured to include the outer blade 22 and the inner blade 42. However, the present invention is not limited thereto.

The main body 2 includes a substantially cylindrical case 10. The case 10 internally accommodates a drive source (as an example, a motor), a battery, and a control circuit board (all are not illustrated). In addition, a power switch 11 is attached to a front surface of the case 10.

In addition, a drive shaft 12 which outputs driving power for rotatably driving the inner blade 42 and the outer blade 22 of the blade unit 16 is arranged while protruding from an upper portion of the main body 2 in a direction toward the head unit 3. The drive shaft 12 engages with a connector portion 14 of a lower portion of the head unit 3 so as to enable connection and disconnection, thereby transmitting the driving power. In the present embodiment, an output from the drive source (motor) is transmitted to the drive shaft 12 via a main body side reduction gear (not illustrated).

On the other hand, the head unit 3 is held so as to be detachable from and tiltable to the main body 2. More specifically, an engagement claw 18 is disposed in a head seat 3B, and an engagement projection 19 which can engage with and disengage from the engagement claw 18 is disposed at a corresponding position of the main body 2. According to this structure, the head unit 3 is configured to be detachable from the main body 2. In the present embodiment, the engagement claw 18 is arranged at a position axially symmetric with the central axis of the connector portion 14, and the engagement projection 19 is arranged at a position axially symmetric with the central axis of the drive shaft 12. In this manner, a holding position (connecting position) of the head unit 3 with respect to the main body 2 can be switched in two ways between a position illustrated in FIG. 2 and a position where the head unit 3 is rotated around the drive shaft 12 as much as an angle of 180° (not illustrated). Therefore, depending on a face portion to be shaved or according to a user's preference, the rotary electric shaver can be used by changing the holding position of the head unit 3. As a modification example, instead of the above-described detachable type, a configuration may be adopted in which the head unit 3 is held so as not to be detachable from the main body 2 (not illustrated).

In addition, as illustrated in FIG. 3, a connection structure is employed in which a bellows member 3C configured by using an elastic material is arranged between a head main body 3A and the head seat 3B. In this manner, the head main body 3A is configured to be tiltable to the head seat 3B held in the main body 2, that is, to the main body 2. According to this configuration, the head unit 3 is tiltable to the main body 2. Therefore, a user can perform further improved skin-fitting shaving, and shaving performance and shaving comfortability can be improved. As a modification example, instead of the above-described tiltable type, a configuration may be adopted in which the head unit 3 is held so as not to be tiltable to the main body 2 (not illustrated).

Figure 5A:
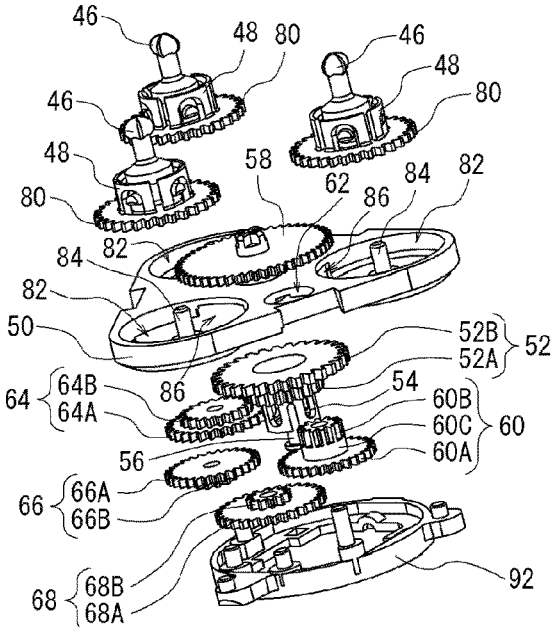
FIGS. 5A to 5C are schematic views illustrating an example of a transmission mechanism of the rotary electric shaver illustrated in FIG. 1.
Figure 5B:
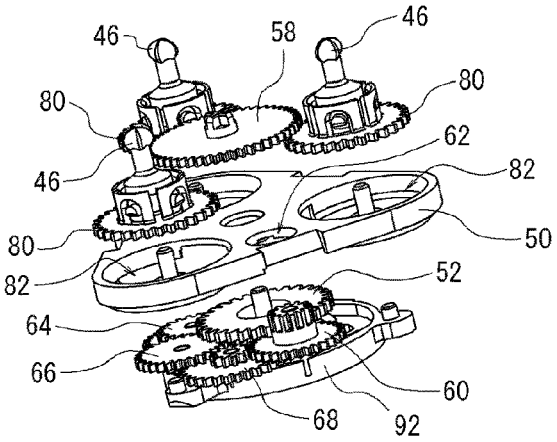
Figure 5C:
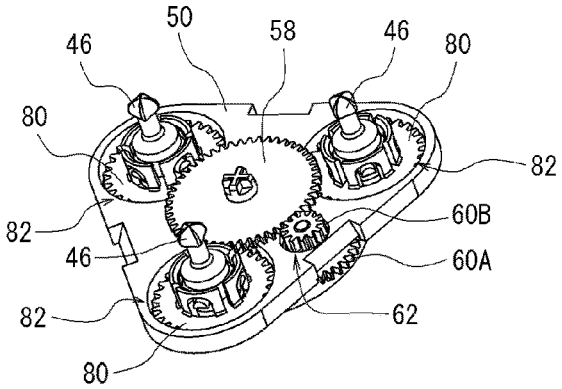
Figure 6A:
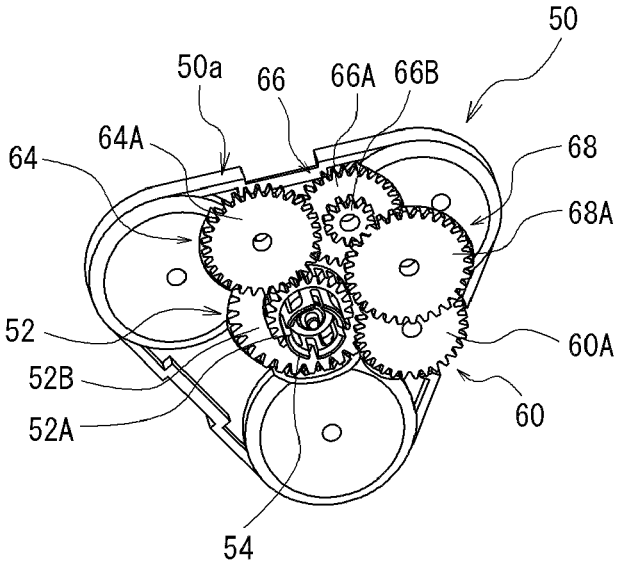
FIGS. 6A and 6B are schematic views illustrating an example of the transmission mechanism of the rotary electric shaver illustrated in FIG. 1.
Figure 6B:
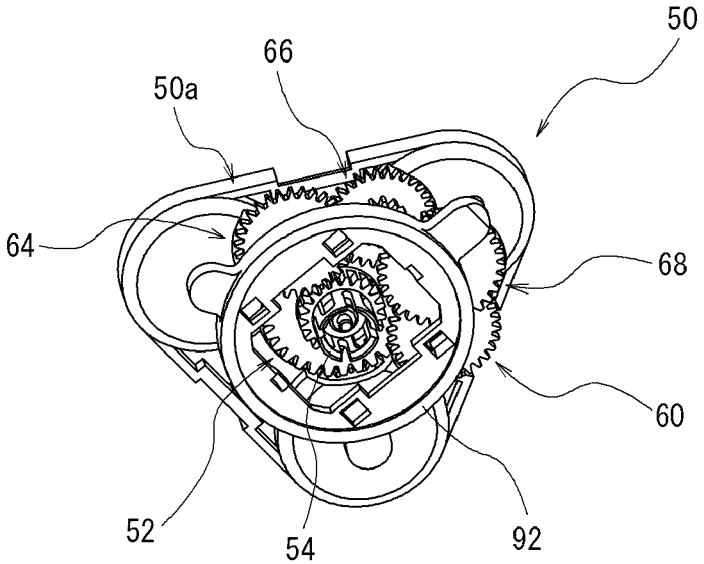

Next, a drive mechanism for rotatably driving the inner blade 42 and the outer blade 22 in the head unit 3 will be described. Here, FIGS. 5A to 5C are upper surface side perspective views illustrating an example of the drive mechanism (FIG. 5A is a disassembly drawing, FIG. 5B is a partial disassembly drawing, and FIG. 5C is an assembly drawing). In addition, FIGS. 6A and 6B are lower surface side perspective views illustrating an example of the drive mechanism (FIG. 6A omits illustration of a gear base 92, and FIG. 6B illustrates the gear base 92).

A gear case 50 is arranged inside the head unit 3 (here, a head case 28), and a lower gear 52 is rotatably held in a lower portion of the gear case 50. More specifically, a minute gap is disposed in one end portion (here, a lower end portion) of the lower gear 52, and a pin 56 having a flange-shaped portion 56*a* which extends in the radial direction is inserted into the minute gap. The lower gear 52 is rotatably held in the gear case 50 in a state of being retained by the flange-shaped portion 56*a*. In addition, the lower gear 52 is connected to the connector portion 14 via a universal joint 54.

Here, the lower gear 52 has a multi-stage structure (here, two stages) which coaxially has an outer blade gear 52A for outputting the driving power to the outer blade 22 and an inner blade gear 52B for outputting the driving power to the inner blade 42. According to this configuration, the lower gear 52 is rotatably driven in such a way that an output of the drive shaft 12 is input as axial force via the connector portion 14 and the universal joint 54. The input driving power is output from the outer blade gear 52A and the inner blade gear 52B.

On the other hand, an upper gear 58 is rotatably held in the upper portion of the gear case 50. More specifically, the upper gear 58 and the lower gear 52 are arranged so as to interpose the gear case 50 therebetween. The other end portion (here, the upper end portion) of the pin 56 is press-fitted to the center of the upper gear 58, and the upper gear 58 is rotatably held in the gear case 50. The upper gear 58 is a gear which outputs the driving power to the outer blade 22 after the output from the above-described outer blade gear 52A is input via a reduction gear (to be described later).

In this way, a structure is realized in which the lower gear 52 and the upper gear 58 are respectively and rotatably held in the gear case 50 by only one component (pin 56). Furthermore, the drive shaft 12, the connector portion 14, the universal joint 54, the lower gear 52, the pin 56, and the upper gear 58 are arranged so that all of the rotary shafts (central axes) are coaxial (however, the axes tilt in response to the movement of the universal joint 54). Accordingly, the number of components can be reduced, and a structure can be simplified in which the outer blade gear 52A and the inner blade gear 52B input and output the driving power. Therefore, the head unit 3 can have a compact size. Furthermore, a tilting structure of the head unit 3 including the universal joint 54 can be simplified and easily realized.

Herein, a mechanism will be described which transmits the output from the outer blade gear 52A of the lower gear 52 to the upper gear 58. In the present embodiment, as an example, the drive source employs a motor which rotates at a rotation speed of approximately 8,000 rpm. Accordingly, if the outer blade 22 coming into contact with a user's skin is rotated at the rotation speed without any change, the action for raising the hair cannot be obtained. Moreover, since the rotation is too fast, there is a risk that the user may feel pains on the skin. Therefore, in order to rotatably drive the outer blade 22 at a proper rotation speed, it is necessary to provide a transmission mechanism for transmitting the driving power by reducing the rotation speed of the drive source. In the present embodiment, the rotation speed of the outer blade 22 is set to approximately 10 rpm. However, the setting is not limited to the rotation speed.

As the above-described transmission mechanism, the present embodiment is first provided with a transmission gear 60. The transmission gear 60 has a relatively large diameter input gear 60A which is arranged in the lower portion of the gear case 50 and to which the driving power is input from the lower gear 52 and a relatively small diameter output gear 60B which is arranged in the upper portion of the gear case 50 and which outputs the driving power to the upper gear 58. The input gear 60A and the output gear 60B are coaxially and rotatably connected to each other. A rotary shaft 60C thereof is arranged so as to penetrate into a through-hole 62 which is vertically formed at a position close to an outer edge 50*a* further from the center of the gear case 50.

Furthermore, the present embodiment is provided with a reduction gear which is arranged in the lower portion of the gear case 50, which transmits the driving power from the lower gear 52 (outer blade gear 52A) to the transmission gear 60, and which reduces the rotation speed. The present embodiment is provided with multiple (as an example, three) reduction gears, specifically, a first reduction gear 64, a second reduction gear 66, and a third reduction gear 68. As a modification example, there is a case of setting multiple reduction gears other than three reduction gears or one reduction gear in accordance with a required speed reduction ratio. Alternatively, there is also a case where the lower gear 52 (outer blade gear 52A) and the transmission gear 60 are caused to directly mesh with each other without disposing any reduction gear (both the cases are not illustrated).

Here, the present embodiment is provided with a multi-stage structure (here, two stages) in which the respective reduction gears (first reduction gear 64, second reduction gear 66, and third reduction gear 68) coaxially have large diameter gears (respectively, 64A, 66A, and 68A) to which the driving power is input (that is, which serve as a driven side) and small diameter gears (respectively, 64B, 66B, and 68B) which output the driving power (that is, which serve as a driving side). In the present embodiment, the respective reduction gears (first reduction gear 64, second reduction gear 66, and third reduction gear 68) are fixed to the lower portion of the gear case 50 in a state of being respectively and rotatably supported together with the transmission gear 60 by the gear base 92.

In addition, the reduction gears adjacent to each other are arranged so that positions of the large diameter gear and the small diameter gear are alternately and vertically inverted. The small diameter gear serving as the driving side and the large diameter gear serving as the driven side mesh with each other. That is, as illustrated in FIGS. 5A to 6B, the first reduction gear 64 is arranged above the large diameter gear 64A, the second reduction gear 66 is arranged above the small diameter gear 66B, and the third reduction gear 68 is arranged above the large diameter gear 68A. In addition, first stage reduced speed is obtained in such a way that the outer blade gear 52A of the lower gear 52 and the large diameter gear 64A of the first reduction gear 64 mesh with each other so as to be capable of transmitting the driving power. Next, second stage reduced speed is obtained in such a way that the small diameter gear 64B of the first reduction gear 64 and the large diameter gear 66A of the second reduction gear 66 mesh with each other so as to be capable of transmitting the driving power. Next, third stage reduced speed is obtained in such a way that the small diameter gear 66B of the second reduction gear 66 and the large diameter gear 68A of the third reduction gear 68 mesh with each other so as to be capable of transmitting the driving power. Next, fourth stage reduced speed is obtained in such a way that the small diameter gear 68B of the third reduction gear 68 and the input gear 60A of the transmission gear 60 mesh with each other so as to be capable of transmitting the driving power. Furthermore, fifth stage reduced speed is obtained in such a way that the output gear 60B of the transmission gear 60 and the upper gear 58 mesh with each other so as to be capable of transmitting the driving power. In this manner, the driving power (rotation output) of the lower gear 52 (outer blade gear 52A) is reduced, and after being transmitted to the transmission gear 60, the driving power is further transmitted to the upper gear 58. According to this configuration, a compact shape can be realized by inhibiting the shape of the head unit 3 from increasing in the thickness direction.

Furthermore, the respective reduction gears (first reduction gear 64, second reduction gear 66, and third reduction gear 68) surround a perimeter around the rotary shaft of the lower gear 52, and are arranged so as to partially overlap the inner blade gear 52B of the lower gear 52 when viewed in the axial direction of the rotary shaft (refer to FIGS. 6A and 6B). This can realize a configuration in which the respective reduction gears (first reduction gear 64, second reduction gear 66, and third reduction gear 68) are arranged so that outer edges in the radial direction (that is, tips of the outer peripheral teeth) are located inward (including the concept of substantially inward) from the outer edge 50*a* of the gear case 50 when viewed in the axial direction of the respective rotary shafts. According to this configuration, a compact shape can be realized by inhibiting the shape of the head unit 3 from increasing in the radial direction.

Accordingly, the head unit 3 can be formed in the compact shape in both the thickness direction (vertical direction) and the radial direction. Therefore, compared to the related art, it is possible to realize the rotary electric shaver which gives a stylish impression by showing good design to attract customers and which includes the head unit 3 excellent in operability.

Subsequently, a mechanism will be described which transmits the output from the inner blade gear 52B of the lower gear 52 to an inner blade drive shaft 46 (to be described later) for driving the inner blade 42. Incidentally, similarly to the above-described outer blade 22, the inner blade 42 also needs to be rotatably driven at a proper speed by reducing the rotation speed of the drive source in order to prevent poor shaving quality while preventing an increase in abrasion of the blade. As an example, in the present embodiment, the rotation speed of the inner blade 42 is set to approximately 2,700 rpm. A main body side reduction gear (not illustrated) reduces the rotation speed.

As the above-described transmission mechanism, a groove 82 which rotatably accommodates an inner blade drive gear 80 for respectively driving each inner blade 42 is disposed on the upper surface of the gear case 50. A support shaft 84 for rotatably supporting the inner blade drive gear 80 is disposed in the center of the groove 82. Furthermore, each groove 82 has an opening 86 which is formed so as to open toward the lower surface side and the central side of the gear case 50 (formed so as to penetrate the upper surface side and the lower surface side). That is, each inner blade drive gear 80 rotatably supported by the support shaft 84 inside each groove 82 meshes with the lower gear 52 (here, the inner blade gear 52B) arranged on the lower surface side of the gear case 50 in such a way that outer peripheral teeth of the inner blade drive gear 80 are exposed from the opening 86 toward the lower surface side and the central side of the gear case 50.

In this way, the driving power (rotation output) of the lower gear 52 (inner blade gear 52B) is transmitted to the inner blade drive gear 80 at a predetermined speed reduction ratio, and is finally transmitted to the inner blade 42.

Figure 7:
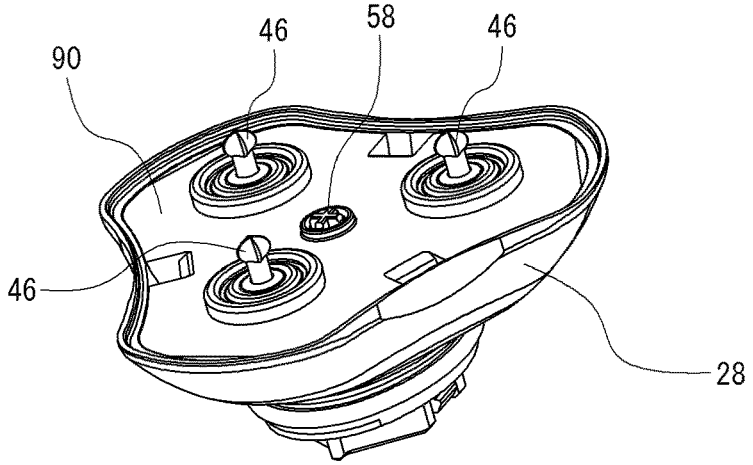
FIG. 7 is a schematic view illustrating an example of a head case and a gear case cap of the rotary electric shaver illustrated in FIG. 1.

As described above, the transmission mechanism configured to include the gear case 50 and the gear base 92 which support each gear is accommodated inside the head case 28. In addition, a gear case cap 90 is arranged above the transmission mechanism. FIG. 7 illustrates a perspective view of the state. This inhibits the inner blade drive gear 80 from falling out from the groove. Furthermore, a blade rest 76 (to be described below) is arranged above the transmission mechanism.

Next, a mechanism will be described which holds and rotates the outer blade 22 and the inner blade 42.

First, the inner blade 42 according to the present embodiment is configured to include multiple small blades 42*a* in which a metal plate is partially erect from a plate surface as illustrated in FIG. 4A. As an example, the inner blade 42 is formed in such a way that the metal plate made of stainless steel is subjected to punching and bending by means of press working. In the present embodiment, the inner blade 42 employs an integral structure using the metal plate, but the embodiment is not limited thereto.

The inner blade 42 is fixed to an inner blade holder 44 made of a resin, and a recess with which an upper end (spherical portion) of the inner blade drive shaft 46 engages is formed in the lower portion of the inner blade holder 44. In a state of being fixed to the inner blade holder 44, the inner blade 42 is rotatably accommodated inside an inner blade case 70. As an example, the inner blade case 70 has an outer cylindrical portion 70A and an inner cylindrical portion 70B, and a substantially double cylindrical structure having a bottom is formed therebetween.

In this state, the upper end spherical portion (refer to FIGS. 5A to 5C) of the inner blade drive shaft 46 enters and engages with the recess formed in the lower portion of the inner blade holder 44 of the inner blade 42 from below so as to be slidable, thereby transmitting the driving power. The engagement structure is merely an example. The present embodiment may employ another joint structure.

The inner blade drive shaft 46 is a member which interlinks with the above-described drive shaft 12 via the above-described lower gear 52 so as to rotatably drive the inner blade 42 by transmitting the driving power of the drive source (motor). The inner blade drive shaft 46 according to the present embodiment has the spherical portion in the upper end, and is held by an inner blade drive joint 48. The inner blade drive shaft 46 has a compressed coil spring (not illustrated) equipped therein, and is configured to show a resetting tendency in the extending direction. The resetting tendency serves as a force applied by the inner blade 42 to the outer blade 22. As an example, each inner blade drive joint 48 is fixed to each inner blade drive gear 80.

On the other hand, multiple hair inlets 23 are formed (that is, by penetrating the lower surface 22*b* from the upper surface 22*a*) on the upper surface 22*a* of the outer blade 22. The outer blade 22 cuts the hair entering the hair inlets 23 by interposing the hair between the lower end portion of the outer blade 22 and the inner blade 42. The outer blade 22 has a substantially cup shape whose peripheral edge is bent downward. A ring-shaped cap 72 is fitted thereto so as to fix the outer blade 22 to the upper portion of the inner blade case 70 (here, the outer cylindrical portion 70A). Therefore, a configuration is adopted in which the outer blade 22 is driven by rotatably driving the inner blade case 70. The hair inlet 23 can employ various shapes such as a radial slit shape, a round hole shape, or a combined shape thereof.

Here, an outer blade drive gear 74 is connected to the inner blade case 70 to which the outer blade 22 is fixed. More specifically, an outer peripheral surface 70*a* in the lower portion of the inner blade case 70 (here, the outer cylindrical portion 70A) is squeezed so as to form a curved surface (or a tilting surface). In addition, the outer blade drive gear 74 is a ring-shaped gear whose outer periphery has teeth. The outer peripheral surface 70*a* of the inner blade case 70 (outer cylindrical portion 70A) is fitted to an inner peripheral surface 74*a* of the outer blade drive gear 74. The inner peripheral surface 74*a* is formed on the curved surface (or the tilting surface) supporting the outer peripheral surface 70*a* so that an angle of the rotary shaft (central axis) of the inner blade case 70 is variable, that is, so that the inner blade case 70 can oscillate.

Furthermore, an engagement projection 74*b* on one side (as an example, the inner peripheral surface 74*a*) and an engagement recess 70*b* on the other side (as an example, the inner peripheral surface 70*a*) which engage with each other so as to transmit the rotary driving power (that is, driving power applied in the circumferential direction) are respectively disposed on the outer peripheral surface 70*a* of the inner blade case 70 (outer cylindrical portion 70A) and the inner peripheral surface 74*a* of the outer blade drive gear 74. As a matter of course, a configuration (not illustrated) may be adopted in which the arrangements are respectively inverted so that the engagement projection is disposed on the outer peripheral surface 70*a* and the engagement recess is disposed on the inner peripheral surface 74*a*.

As described above, each blade unit 16 is configured to have the outer blade 22 and the inner blade 42. In each blade unit 16, the inner blade case 70 connected to the outer blade drive gear 74 is driven by rotatably driving the outer blade drive gear 74, thereby performing an operation for driving the outer blade 22 fixed to the inner blade case 70. On the other hand, the inner blade drive shaft 46 is rotatably driven, thereby performing an operation for driving the inner blade 42 which is accommodated inside the inner blade case 70 and which is connected to the inner blade drive shaft 46.

Here, each blade unit 16 is arranged on the blade rest 76. More specifically, a configuration is adopted in which the respective outer blade drive gears 74 having the inner blade case 70 connected thereto are mounted on respective ring portions 76A, 76B, and 76C of the blade rest 76 formed in a triple ring shape. In addition, a center gear 78 which meshes with each outer blade drive gear 74 of each blade unit 16 so as to transmit the driving power is rotatably arranged in the central portion of the blade rest 76. Furthermore, the lower end of the center gear 78 engages with the upper end of the rotary shaft (central axis) of the upper gear 58 protruding from the above-described gear case cap 90 so as to enable connection and disconnection, thereby transmitting the driving power (refer to FIG. 7).

Figure 8:
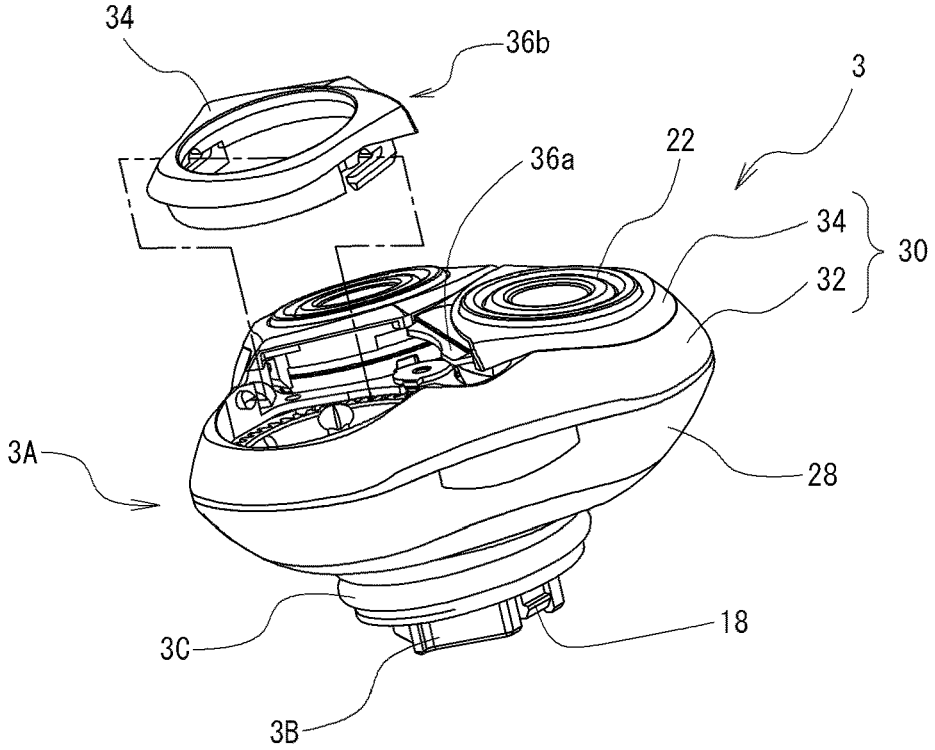
FIG. 8 is a view for describing a configuration of a blade frame body of the rotary electric shaver illustrated in FIG. 1.

A blade frame body 30 is fitted to the blade rest 76 having each blade unit 16 arranged therein, from above, thereby holding each blade unit 16. Here, the blade frame body 30 includes a configuration in which the outer blade case 34 is fitted to the outer blade frame 32 connected to the head case 28, at a position corresponding to each outer blade 22. FIG. 8 illustrates a partially exploded perspective view of the state. As described above, in a state of being fixed to the inner blade case 70, the outer blade 22 is configured so that an angle of the rotary shaft (central axis) is variable with respect to the outer blade drive gear 74, that is, with respect to the blade rest 76. In other words, the outer blade 22 can oscillate. In order to enable each outer blade case 34 to follow this movement, a configuration is adopted in which the respective outer blade cases 34 are movable with respect to the outer blade frame 32 in a seesaw manner while being linked with each other.

Figure 9A:
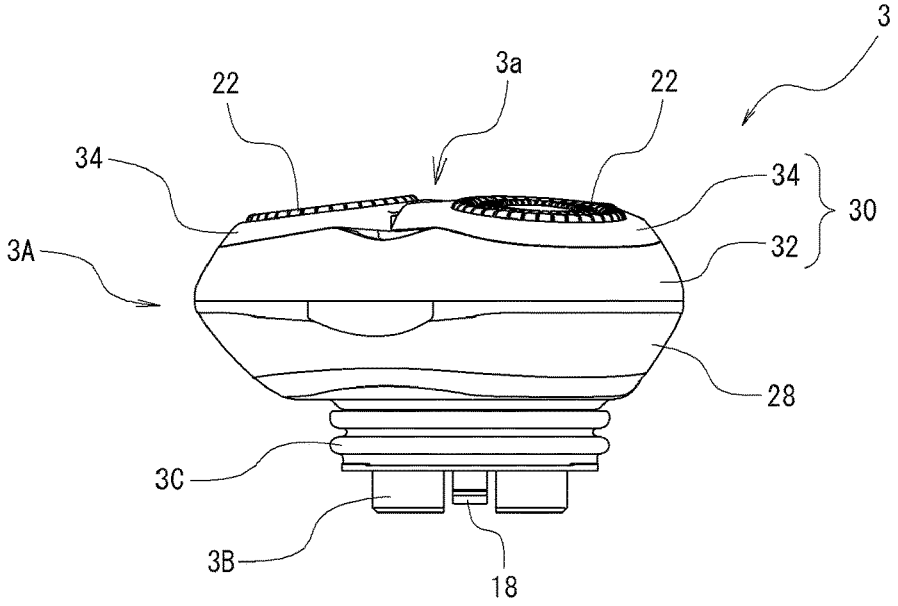
FIGS. 9A and 9B are views for describing an operation of an outer blade case of the rotary electric shaver illustrated in FIG. 1.
Figure 9B:
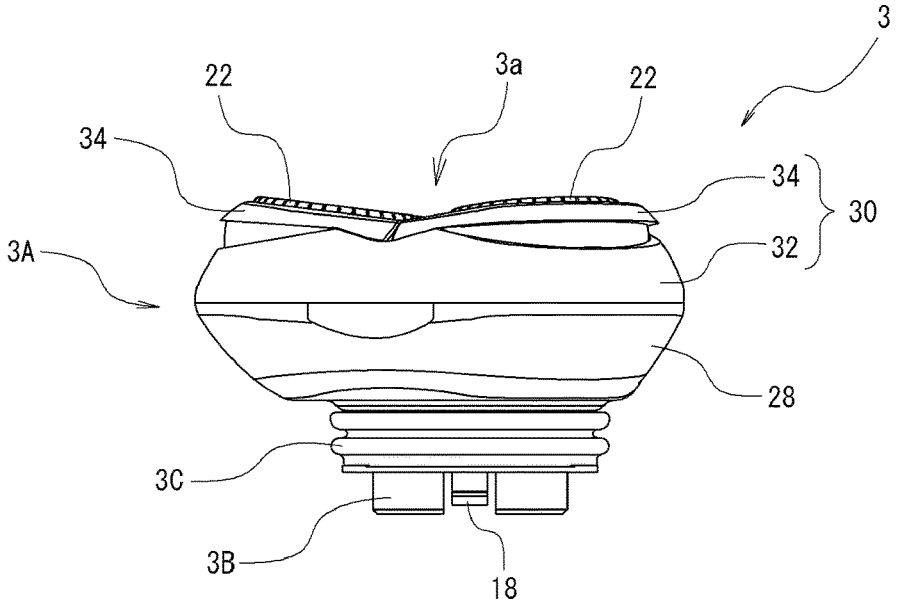

As an example, there is provided a configuration in which the adjacent outer blade cases 34 are connected to and integrated with each other by connection portions 36*a* and 36*b*. A bending operation of the outer blade cases 34 can be performed in the connection portions. This realizes a configuration in which all of the outer blade cases 34 fitted onto the outer blade frame 32 are operated while being linked with each other (all of the connection portions perform the bending operation). FIGS. 9A and 9B are views for describing the operation.

According to the above-described configuration, a configuration can be adopted in which the upper surface 3*a* of the head unit 3 is transformable between a state of serving as a convex surface state (refer to FIG. 9A) and a state of serving as a concave surface (refer to FIG. 9B). In this way, it is possible to realize a structure in which the upper surface 3*a* of the head unit 3 where the upper surface 22*a* (shaving surfaces 22A and 22B) of the outer blade 22 is arranged thereon is transformable between the convex surface and the concave surface. Accordingly, a user can perform further improved skin-fitting shaving, and shaving performance and shaving comfortability can be improved.

In addition, as described above, the present embodiment includes a configuration in which the inner blade 42 comes into contact with the outer blade 22 while being held by the inner blade drive shaft 46 held in the inner blade drive joint 48. According to this configuration, the inner blade 42 is held to be capable of oscillating by the spherical portion of the inner blade drive shaft 46. Accordingly, the inner blade 42 can follow the tilting movement of the outer blade 22. Furthermore, the resetting tendency of the inner blade drive joint 48 using a coil spring (not illustrated) also enables the inner blade 42 to follow the vertical movement and the tilting movement of the outer blade 22. Therefore, this realizes a configuration in which the inner blade 42 always comes into contact with and is pressed against the lower surface of the outer blade 22.

As described above, according to the rotary electric shaver 1 in the present invention, not only the inner blade 42 but also the outer blade 22 can be rotatably driven by using the reduced number of components and a simple structure. Accordingly, a user's hand moving operation can be reduced. Therefore, when in use, the user's hand or arm can feel reduced fatigue, and improved shaving can be conveniently performed. Furthermore, the user's action for raising and catching the hair can be improved. Therefore, shaving performance and shaving comfortability can be improved.

In addition, although the inner blade 42 and the outer blade 22 can be rotatably driven, the head unit 3 can have a compact shape in both the thickness direction and the radial direction. Accordingly, operability can be satisfactorily improved, an accommodating space can be minimized, and usability can be improved. Furthermore, it is possible to give a stylish impression by showing neat design. Therefore, customer attracting power can also be improved.

In addition, although the inner blade 42 and the outer blade 22 can be rotatably driven, a configuration can be adopted in which the head unit 3 is detachable from and tiltable to the main body 2. Furthermore, a configuration can be adopted in which the outer blade 22 and the outer blade case 34 are movable (tiltable) in the head unit 3 in a seesaw manner. Accordingly, a user can perform further improved skin-fitting shaving, and shaving performance and shaving comfortability can be improved.

Without being limited to the above-described embodiment, the present invention can be modified in various ways within the scope not departing from the gist of the present invention. In particular, the rotary electric shaver having three sets of blade units has been described as an example. However, without being limited thereto, the present invention is also applicable to a rotary electric shaver having other multiple sets (for example, two sets, four or more sets) of blade units.

The invention claimed is:

1. A rotary electric shaver in which multiple blade units having an outer blade whose upper surface serves as an annular shaving surface and an inner blade coming into sliding contact with a lower surface of the outer blade are arranged in a head unit held in a main body, and in which the outer blade and the inner blade are respectively and rotatably driven, the rotary electric shaver comprising:

a gear case that is arranged inside the head unit;

a lower gear, the lower gear having a multi-stage structure and arranged in a lower portion of the gear case, and that coaxially has an outer blade gear to which driving power is input from a drive source accommodated in the main body and which outputs the driving power to the outer blade, and an inner blade gear which outputs the driving power to the inner blade;

an upper gear that is arranged in an upper portion of the gear case, and that outputs the driving power to the outer blade; and a transmission gear that has an input gear which is arranged in the lower portion of the gear case and to which the driving power is input from the lower gear, and an output gear which is arranged in the upper portion of the gear case and which outputs the driving power to the upper gear, in which the input gear and the output gear are coaxially and rotatably connected to each other, and in which a rotary shaft thereof is arranged so as to vertically penetrate the gear case, wherein the driving power from the upper gear drives an outer blade drive gear which drives the outer blade.

2. The rotary electric shaver according to claim 1, further comprising:

a plurality of reduction gears that transmit the driving power from the lower gear to the transmission gear, and that reduce rotation speed, wherein each reduction gear has a multi-stage structure which coaxially has large diameter gears and small diameter gears, and wherein the reduction gears adjacent to each other are arranged so that the large diameter gears and the small diameter gears are alternately and vertically inverted, and the small diameter gears of the reduction gears serving as a driving side and the large diameter gears of the reduction gears serving as a driven side mesh with each other.

3. The rotary electric shaver according to claim 2, wherein the respective reduction gears surround a perimeter around a rotary shaft of the lower gear, and are arranged so as to overlap the inner blade gear of the lower gear when viewed in the axial direction.

4. The rotary electric shaver according to claim 2, wherein the respective reduction gears are arranged so that an outer edge thereof is located inward from an outer edge of the gear case when viewed in the axial direction.

5. The rotary electric shaver according to claim 3, wherein the respective reduction gears are arranged so that an outer edge thereof is located inward from an outer edge of the gear case when viewed in the axial direction.

6. The rotary electric shaver according to claim 1, further comprising:

a pin that has a flange-shaped portion which extends in the radial direction in one end portion, wherein the lower gear into which the pin is rotatably inserted and which is retained by the flange-shaped portion and the upper gear into which the other end portion of the pin is press-fitted are arranged so as to interpose the gear case therebetween, and are respectively and rotatably held in the gear case by the pin.

7. The rotary electric shaver according to claim 1, wherein the head unit is held so as to be detachable from and tiltable to the main body, wherein a lower portion of the head unit includes a connector portion which engages with a drive shaft to which the driving power is output from the drive source of the main body, and wherein the connector portion is connected to the lower gear via a universal joint.

8. The rotary electric shaver according to claim 1, further comprising:

an inner blade case that rotatably accommodates the inner blade, wherein the outer blade is fixed to an upper portion of the inner blade case, and wherein the outer blade drive gear is connected to the inner blade case.

9. The rotary electric shaver according to claim 2, further comprising:

an inner blade case that rotatably accommodates the inner blade, wherein the outer blade is fixed to an upper portion of the inner blade case, and wherein the outer blade drive gear is connected to the inner blade case.

10. The rotary electric shaver according to claim 3, further comprising:

an inner blade case that rotatably accommodates the inner blade, wherein the outer blade is fixed to an upper portion of the inner blade case, and wherein the outer blade drive gear is connected to the inner blade case.

11. The rotary electric shaver according to claim 4, further comprising:

an inner blade case that rotatably accommodates the inner blade, wherein the outer blade is fixed to an upper portion of the inner blade case, and wherein the outer blade drive gear is connected to the inner blade case.

12. The rotary electric shaver according to claim 5, further comprising:

an inner blade case that rotatably accommodates the inner blade, wherein the outer blade is fixed to an upper portion of the inner blade case, and wherein the outer blade drive gear is connected to the inner blade case.

13. The rotary electric shaver according to claim 6, further comprising:

an inner blade case that rotatably accommodates the inner blade, wherein the outer blade is fixed to an upper portion of the inner blade case, and wherein the outer blade drive gear is connected to the inner blade case.

14. The rotary electric shaver according to claim 7, further comprising:

an inner blade case that rotatably accommodates the inner blade, wherein the outer blade is fixed to an upper portion of the inner blade case, and wherein the outer blade drive gear is connected to the inner blade case.

15. The rotary electric shaver according to claim 8, wherein in the inner blade case, an outer peripheral surface of a lower portion is formed on a tilting surface or a curved surface, and wherein the outer blade drive gear has a ring shape, and an inner peripheral surface thereof is formed on the tilting surface or the curved surface which supports the outer peripheral surface so that the outer peripheral surface of the inner blade case can be fitted to the inner peripheral surface and an angle therebetween is variable.

16. The rotary electric shaver according to claim 8, wherein an engagement projection on one side and an engagement recess on the other side which engage with each other so as to transmit the rotary driving power are respectively disposed on the outer peripheral surface of the inner blade case and the inner peripheral surface of the outer blade drive gear.

17. The rotary electric shaver according to claim 15, wherein an engagement projection on one side and an engagement recess on the other side which engage with each other so as to transmit the rotary driving power are respectively disposed on the outer peripheral surface of the inner blade case and the inner peripheral surface of the outer blade drive gear.

18. The rotary electric shaver according to claim 1, wherein an upper surface of the gear case has a groove which rotatably accommodates an inner blade drive gear for driving the inner blade, wherein the groove has an opening which is open on a lower surface side of the gear case, and wherein the inner blade drive gear is exposed from the opening, and meshes with the lower gear.

19. The rotary electric shaver according to claim 18, further comprising:

a blade rest that is arranged above the gear case, and that rotatably supports the outer blade drive gear.

* * * * *